United States Patent [19]

Shibata

[11] 4,191,154

[45] Mar. 4, 1980

[54] EVAPORATED FUEL VAPOR CONTROL DEVICE FOR USE IN AN INTERNAL COMBUSTION ENGINE

[75] Inventor: Norio Shibata, Susono, Japan

[73] Assignee: Toyota Jidosha Kogyo Kabushiki Kaisha, Toyota, Japan

[21] Appl. No.: 874,757

[22] Filed: Feb. 3, 1978

[30] Foreign Application Priority Data

Aug. 29, 1977 [JP] Japan ..... 52-114467[U]

[51] Int. Cl.[2] ..... F02M 7/20

[52] U.S. Cl. ..... 123/136; 261/69 R

[58] Field of Search ..... 123/136; 261/69 R, 39 A, 261/39 B, 67, 121 B

[56] References Cited

U.S. PATENT DOCUMENTS

| | | | |
|---|---|---|---|
| 3,296,023 | 12/1966 | Sarto | 261/72 R |
| 3,393,669 | 7/1968 | Vardi et al. | 123/136 |
| 3,515,107 | 6/1970 | Joyce | 261/72 R |
| 3,548,797 | 12/1970 | Hagihara et al. | 261/72 R |
| 3,675,634 | 7/1972 | Tatsutomi et al. | 123/136 |
| 3,759,234 | 9/1973 | Buckton et al. | 123/136 |
| 3,763,839 | 10/1973 | Alquist | 123/136 |
| 3,859,397 | 1/1975 | Tryon | 261/39 A |
| 3,888,223 | 6/1975 | Mondt | 123/136 |
| 3,913,545 | 10/1975 | Haase et al. | 123/136 |
| 3,933,951 | 6/1976 | Fischer et al. | 261/DIG. 74 |
| 3,936,516 | 2/1976 | Nakagawa et al. | 261/39 A |
| 3,996,908 | 12/1976 | Brown et al. | 261/DIG. 74 |
| 4,000,727 | 1/1977 | Walker | 123/136 |
| 4,086,897 | 5/1978 | Tamuru et al. | 123/136 |
| 4,112,898 | 9/1978 | Takimoto et al. | 123/136 |

*Primary Examiner*—Charles J. Myhre
*Assistant Examiner*—R. A. Nelli
*Attorney, Agent, or Firm*—Stevens, Davis, Miller & Mosher

[57] ABSTRACT

Disclosed is an internal combustion engine having a charcoal canister. The float chamber of the carburetor is connected to the canister via an evaporated fuel vapor passage. The carburetor has therein a slow fuel passage connected to the slow port which opens into the intake passage of the engine. The slow fuel passage is opened and, at the same time, the evaporated fuel vapor passage is closed by means of a single electromagnetic valve when the ignition switch is turned to the ON condition.

6 Claims, 1 Drawing Figure

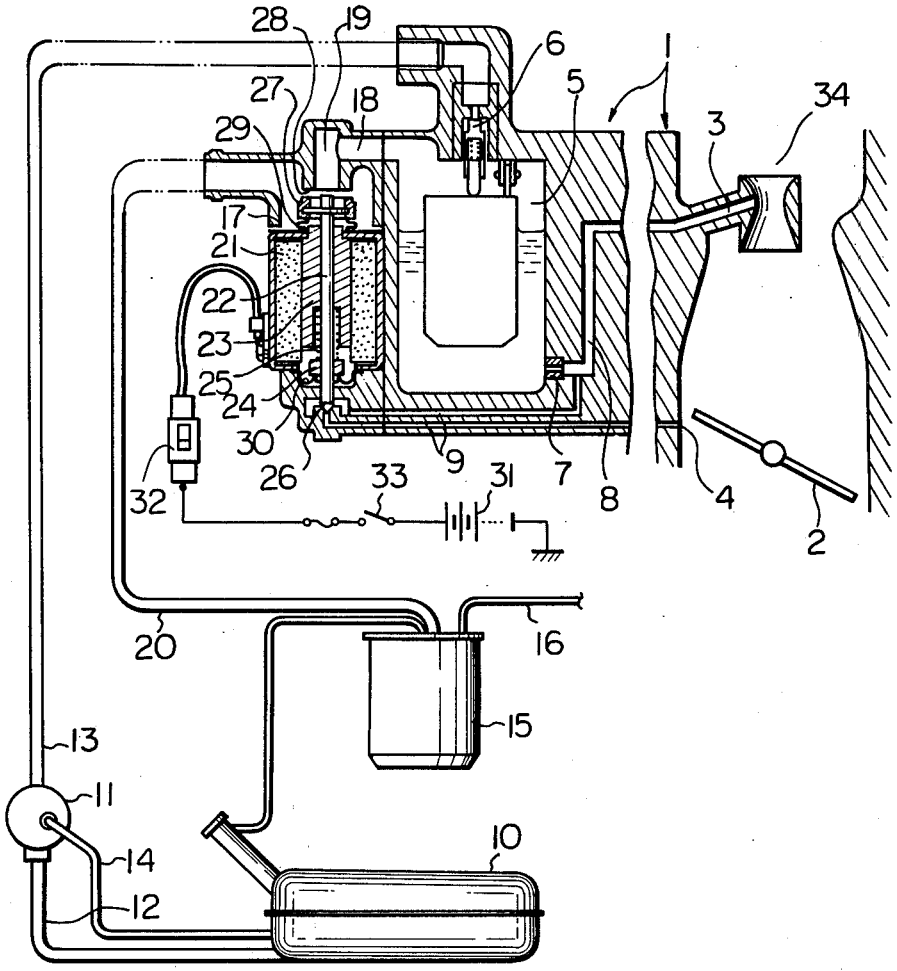
28
19
6
1
27
18
5
34
29
3
17
21
22
23
25
24
30
26
9
7
8
4
2
32
33
31
20
16
15
13
11
14
12
10

EVAPORATED FUEL VAPOR CONTROL DEVICE FOR USE IN AN INTERNAL COMBUSTION ENGINE

DESCRIPTION OF THE INVENTION

The present invention relates to an evaporated fuel vapor control device for use in a vehicle.

The limitations on the amount of emissions discharged from engines into the atmosphere are becoming continually more severe as the years go by and, accordingly, difficult problems are arising in that the emission control systems are becoming more complicated and, at the same time, the manufacturing cost of the emission control systems is increasing. Consequently, at present, a great amount of effort is being spent in the development of a novel emission control technique, on the one hand, and in the simplification of a conventional emission control system, on the other hand.

There are various kinds of emissions which are the object of the limitations on the amount of emissions discharged to the atmosphere. As one of such emissions, there is the evaporated fuel vapor dicharged from the fuel tank and the carburetor into the atmosphere. In order to control the discharge of such evaporated fuel vapor, there has been proposed a control system wherein the evaporated fuel vapor is temporarily absorbed in a vapor-storage canister containing active charcoal therein and, then, the absorbed evaporated fuel vapor is purged into the intake system of the engine when the engine is rotating under a predetermined particular operating condition. In such an engine, while the evaporated fuel vapor discharged from the fuel tank can be introduced into the vapor-storage canister irrespective of whether the engine is operating or is stopped, the evaporated fuel vapor discharged from the carburetor cannot always be introduced into the vapor-storage canister. That is, the carburetor is usually so set that the air-fuel mixture of an optimum air-fuel ratio is formed in the carburetor when the pressure in the float chamber of the carburetor is maintained at the same level as the pressure in the interior of the air filter element of the air cleaner, which is slightly lower than the atmospheric pressure. However, in the case wherein the float chamber of the carburetor is always in communication with the vapor-storage canister for always feeding the evaporated fuel gas into the vapor-storage canister, since the inside of the canister is maintained at the atmospheric pressure, the pressure in the float chamber of the carburetor becomes equal to the atmospheric pressure. The results in a problem in that the air-fuel mixture formed in the carburetor becomes excessively rich. Consequently, it is necessary to only communicate the float chamber with the interior of the air filter element when the engine is operating by closing the evaporated fuel vapor passage communicating the float chamber with the vapor-storage canister. In a conventional engine, a control valve such as an electromagnetic valve is disposed in the evaporated fuel vapor passage for closing the evaporated fuel vapor passage when the engine is operating. However, the provision of such a control valve requires a complicated construction and results in an increase in the manufacturing cost of a system.

On the other hand, in a conventional engine, there is a problem in that, after the ignition switch is turned to the OFF condition, the engine may continue rotating due to the occurrence of self-ignition. This state is called run-on. In order to avoid the problem of run-on some conventional engines are provided with fuel cut-off valves for preventing the fuel from being fed into the intake system from the slow fuel port of the carburetor when the ignition switch is turned to the OFF condition.

An object of the present invention is to provide an evaporated fuel vapor control device of a simple construction and a low manufacturing cost.

According to the present invention, there is provided an emission control device of an internal combustion engine having an intake passage equipped with a throttle valve therein, said device comprising: a carburetor having a float chamber and a slow fuel passage communicating said float chamber with said intake passage, said float chamber having therein an upper space connected to said intake passage located upstream of said throttle valve; a canister containing active charcoal therein; an evaporated fuel vapor passage communicating said canister with the upper space of said float chamber, and; a single valve device for opening said slow fuel passage and closing said evaporated fuel vapor passage when the engine is operated.

The present invention may be more fully understood from the description of a preferred embodiment of the invention set forth below, together with the accompanying drawing.

BRIEF DESCRIPTION OF THE DRAWING

The FIGURE of the drawing is a schematic view of an evaporated fuel vapor control device according to the present invention.

DESCRIPTION OF A PREFERRED EMBODIMENT

Referring to the FIGURE, 1 designates a carburetor, 2 a throttle valve, 3 a main nozzle and 4 a slow fuel port; 5 designates a float chamber, 6 a liquid surface level regulating valve, 7 a main jet connected to the main nozzle 3 via a main fuel passage 8 and 9 a slow fuel passage communicating the slow port 4 with the main fuel passage 8; 10 designates a fuel tank, 11 a fuel pump driven by an engine, 12 and 13 fuel supply conduits, 14 a fuel return conduit, and 15 a vapor-storage canister containing active charcoal therein. The inside of the fuel tank 10 is connected to the canister 15 so that the evaporated fuel vapor is always fed into the canister 15. On the other hand, the inside of the canister 15 is connected to the intake system of the engine so that the evaporated fuel vapor absorbed in the active charcoal is purged into the intake system via a purge conduit 16.

The float chamber 5 is connected to a vapor chamber 17 via a horizontal passage 18 and a vertical passage 19, and the vapor chamber 17 is connected to the canister 15 via a vapor conduit 20. A solenoid 21 is disposed in the housing of the carburetor 1 and a valve rod 22 is slidably mounted on a core 23 of the solenoid 21. The valve rod 22 has at its lower portion an enlarged portion 24, and a compresssion spring 25 is arranged between the enlarged portion 24 and the core 23 so that the valve rod 22 is always urged downwards by the spring force of the compression spring 25. When the valve rod 22 is positioned in the position shown in the FIGURE, the lower end face of the valve rod 22 abuts against a valve port 26 so that the feeding operation of the fuel from the slow port 4 remains stopped. On the other hand, a valve head 27 is fixed onto the upper end of the valve rod 22 and arranged to face a valve seat 28. The solenoid 21 is completely isolated from the fuel and the evaporated fuel vapor by means of a bellows 29 and a flexible seal member 30 for preventing the occurrence of explosion. The solenoid 21 is connected to a power source 31 via a connector 32 and an ignition switch 33.

The FIGURE shows the state wherein the ignition switch 33 is in the OFF condition, that is, the engine is not operated. At this time, the slow fuel passage 9 is closed by the valve rod 22, and the evaporated fuel vapor in the float chamber 5 continues to be introduced into the canister 15 via the vapor conduit 20. When the ignition switch 33 is turned to the ON condition since the solenoid 21 is energized, the valve rod 22 moves upwards to open the slow fuel passage 9. At the same time, the valve head 27 comes into contact with the valve seat 28 and, as a result, the feed operation of the evaporated fuel vapor into the canister 15 is stopped. In addition, at this time, since the float chamber 5 is connected to the intake passage 34, located upstream of the throttle valve 2, via an air vent (not shown), the inside of the float chamber 5 is maintained at a pressure which is equal to that in the interior of the air filter element of the air cleaner (not shown).

According to the present invention, since the slow fuel feed control and the evaporated fuel vapor feed control are carried out by using a common valve, the construction of the carburetor is simplified and the manufacturing cost thereof is reduced as compared with the conventional case wherein two separate valves are provided for controlling the feeding operation of the slow fuel and the evaporated fuel vapor. In addition, since the solenoid is arranged at a position closely adjacent to the float chamber, the solenoid is appropriately cooled by the fuel in the float chamber and, as a result, satisfactory performance of the operation of the solenoid can be obtained.

While the invention has been described by reference to a specific embodiment chosen for purposes of illustrations, it should be apparent that numerous modifications could be made thereto by those skilled in the art without departing from the spirit and scope of the invention.

What is claimed is:

1. An emission control device of an internal combustion engine having an intake passage with a throttle valve therein, said device comprising:

a carburetor having a float chamber and a slow fuel passage fluidly communicating said intake passage with the lower interior of said float chamber, which is filled with liquid fuel, said float chamber having therein an upper air space;

a canister containing an active charcoal therein;

an evaporated fuel vapor passage fluidly communicating said canister with the upper air space of said float chamber;

a single valve device in said slow fuel passage and in said evaporated fuel vapor passage, said valve device normally closing said slow fuel passage and substantially simultaneously opening said evaporated fuel vapor passage; and means for actuating said valve device to open said slow fuel passage and substantially simultaneously close said evaporated fuel vapor passage when the engine is operating.

2. An emission control device as claimed in claim 1, wherein said valve device comprises a common movable valve body having on its opposite ends a first valve and a second valve, which are arranged in said slow fuel passage and said evaporated fuel vapor passage, respectively.

3. An emission control device as claimed in claim 2, wherein said valve device further comprises an electromagnetic apparatus having a solenid for actuating said valve body.

4. An emission control device as claimed in claim 3, wherein said engine further comprises an ignition switch, said solenoid being energized when said ignition switch is turned to the ON condition.

5. An emission control device as claimed in claim 3, wherein said solenoid is completely isolated from the fuel and the evaporated fuel vapor by means of a pair of flexible seal members.

6. An emission control device as claimed in claim 3, wherein said solenoid is arranged at a position closely adjacent to said float chamber.

* * * * *